US005251751A

United States Patent [19]

Prussen

[11] Patent Number: 5,251,751

[45] Date of Patent: Oct. 12, 1993

[54] COLOR CODED KIT OF RIVETS ACCORDING TO LENGTH

[76] Inventor: Ernest Prussen, 3842 Hudson Ave., Seaford, N.Y. 11783

[21] Appl. No.: 969,985

[22] Filed: Nov. 2, 1992

[51] Int. Cl.[5] ..... B65D 85/58

[52] U.S. Cl. ..... 206/338; 206/459.5

[58] Field of Search ..... 206/338–348, 206/232, 459.1, 459.5, 231

[56] References Cited

U.S. PATENT DOCUMENTS

| | | | |
|---|---|---|---|
| 650,705 | 5/1900 | Bray | 206/338 |
| 1,079,141 | 11/1913 | Perkins | 206/338 |
| 1,946,808 | 2/1934 | Peirce | 206/231 |
| 4,090,606 | 5/1978 | Dawson | 206/459.5 |
| 4,874,084 | 10/1989 | Strausser | 206/338 |

*Primary Examiner*—Jimmy G. Foster
*Attorney, Agent, or Firm*—Richard L. Miller

[57] ABSTRACT

A color coded kit of rivets according to length is provided which consists of a receptacle having a plurality of compartments and a plurality of different sets of rivets. Each set of rivets being of a different length and color stored in one of the compartments. A chart is supplied for indicating the length and matching color of each set of rivets within the receptacle, so that a person can immediately identify by color from the chart the rivets of desired length and remove them for appropriate use from the receptacle.

1 Claim, 1 Drawing Sheet

COLOR CODED KIT OF RIVETS ACCORDING TO LENGTH

BACKGROUND OF THE INVENTION

The instant invention relates generally to gauging and sorting devices and more specifically it relates to a color coded kit of various rivets according to their particular lengths.

Numerous gauging and sorting devices have been provided in the prior art that are adapted to identify items and to separate them according to class, kind and size. For example, U.S. Pat. Nos. 3,709,328 to Oberboihingen et al; 3,731,795 to Velthoven; 3,863,349 to Wilson; 4,295,569 to Niederer; 4,341,311 to Gold et al and 4,877,138 to Motiwala all are illustrative of such prior art. While these units may be suitable for the particular purpose to which they address, they would not be as suitable for the purpose of the present invention as hereafter described.

SUMMARY OF THE INVENTION

A primary object of the present invention is to provide a color coded kit of rivets, that all have the same diameter, according to various respective lengths that will overcome the shortcomings of the prior art devices.

Another object is to provide a color coded kit of rivets by length in which kit is divided into a plurality of compartments for storing the different color coded rivets therein of various lengths, so that the rivets can be removed and used properly therefrom.

An additional object is to provide a color coded kit of rivets by length in which the underside of the cover of the kit identifies the various different color coded rivets stored within the compartments within the kit for instant identification, so that the rivets can be properly used after they have been selected.

Yet another helpful object of a color coded kit of rivets, is when removing rivets for use therefrom, should any drop into an adjoining compartment the rivet can be easily seen by the user so that it will be obvious, that they are not in their proper place.

A further object is to provide a color coded kit of rivets by length that is simple and easy to use.

A still further object is to provide a color coded kit of rivets by length that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
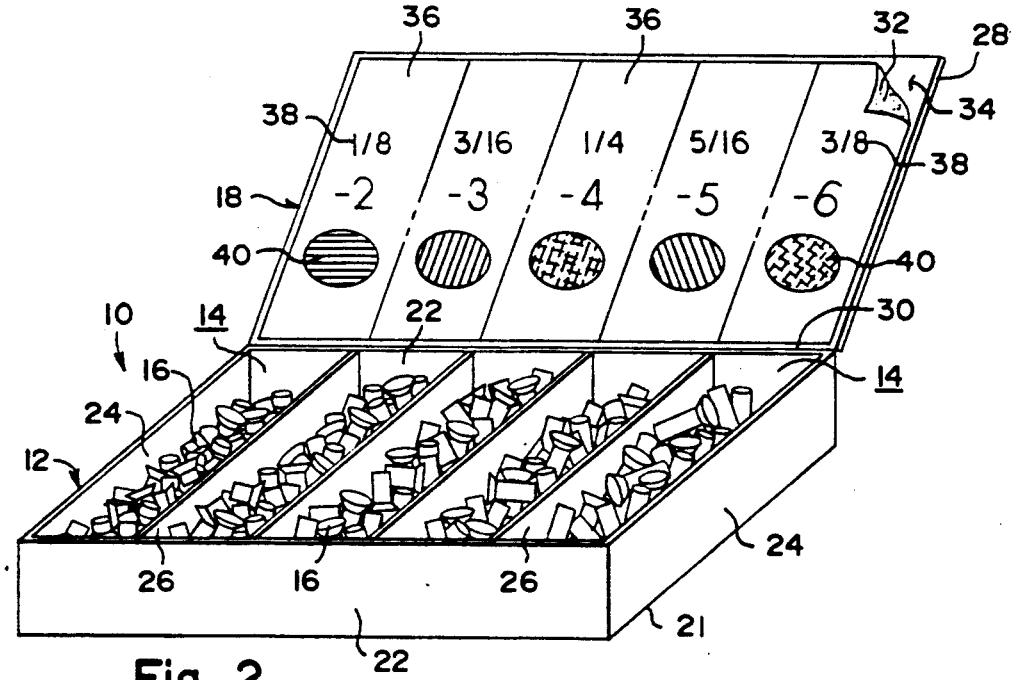
FIG. 2 illustrates the color coded rivets with the color not shown for clarity and an appropriately encoded receptacle for storing and dispensing same.

Turning now descriptively to the drawings, in which similar reference characters denote similar elements throughout the several views, FIG. 2 illustrates a color coded kit 10 of rivets by length, which consists of a receptacle 12 having a plurality of compartments 14. A plurality of each different length rivets 16 are provided. Each of the set of rivets 16 is of a different length and color and is stored in one of the compartments 14. A chart 18 is for indicating the length and matching color of each set of rivets 16 within the receptacle 12, so that a person 20 can immediately identify by color from the chart 18 the correct length rivets 16 to be used and remove them from the receptacle 12.

The receptacle 12 includes a bottom wall 21, a pair of upstanding side walls 22, a pair of upstanding end walls 24 and a plurality of upstanding partition walls 26 spaced apart and parallel to the end walls 24 for dividing the receptacle 12 into the plurality of compartments 14 for storing the different length sets of rivets 16. The receptacle 12 further includes a lid 28 hinged at 30 to one of the side walls 22 and is of a size to completely cover the plurality of compartments 14 in the receptacle 12 to protect the different sets of rivets 16 therein.

The chart 18 includes an adhesive backing 32, so that the chart can be attached to the underside 34 of the lid 28. A plurality of spaced apart columns 36 are provided with each column 36 being of a width approximately of a width of each compartment 14 and has indicia 38 and 40 thereon indicating the length and matching color of the respective plurality of rivets 16 within the compartment 14. When the lid 28 is opened the person 20 who is using the rivets 16 is outside the fuselage 42 and accordingly can see all of the sets of rivets 16 within all of the compartments 14 and easily identify them from the chart 18.

Figure 3:
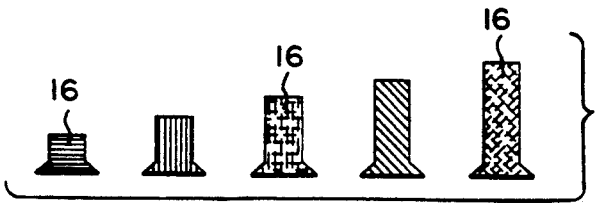
FIG. 3 is a schematic diagrammatic view illustrating the typical color coded set of rivets used in the instant invention.

The length indicia 38 can be typically, but not limited to the sizes as indicated in FIG. 2, which are $\frac{1}{8}''$, 3/16", $\frac{1}{4}''$, 5/16" and $\frac{3}{8}''$. The color indicia 40 can be typically but not limited to the colors as indicated in FIG. 2 which are blue, red, yellow, green and orange and are shown on the different rivets 16 in FIG. 3.

The indicia 38 may include the length of the rivet as both a fraction, and a decimal (not illustrated) in addition to the last digit of U.S. Military Spec Number, that is −2, −3, −4, −5, and −6 which corresponds to the indicated length of the rivets in 1/16 of an inch in this particular case illustrated respectively $\frac{1}{8}''$, 3/16", $\frac{1}{4}''$, 5/16" and $\frac{3}{8}''$.

Figure 1:
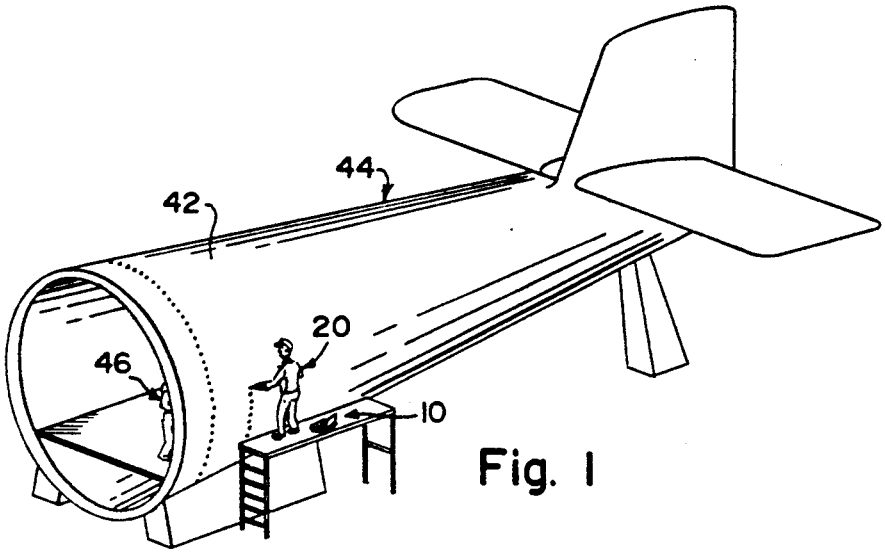
FIG. 1 is a perspective view illustrating a typical application for use of color coded rivets from the instant invention.

When the rivets 16 are being used in fabricating the fuselage 42 of an aircraft 44 etcetera, as shown in FIG. 1, the person 46 on the interior of the fuselage 42 can identify by visual observation by the color of the rivets 16 if the person 20 on the exterior of the fuselage 42 is using the correct rivets 16.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A color coded kit of rivets according to length which comprises:

a) a receptacle having a plurality of compartments, wherein said receptacle includes:

i) a bottom wall;

ii) a pair of upstanding side walls;

iii) a pair of upstanding end walls;

iv) a plurality of upstanding partition walls spaced apart and parallel to said end walls for dividing said receptacle into said plurality f compartments; and v) a lid hinged to one of said side walls and being of a size to a completely cover said plurality of compartments in said receptacle;

b) a plurality of different sets of rivets, each said set of rivets being of a different length and color stored in one of said compartments; and c) a chart for indicating the length and matching color of each said set of rivets within said receptacle, so that a person can immediately identify by color from said chart, the length of rivets required and remove them from said receptacle, whereby when the user is removing rivets for use therefrom, should any drop into an adjoining compartment the rivet can be easily seen by the user so that it will be obvious, that they are not in their proper place, wherein said chart includes:

i) an adhesive backing, so that said chart can be attached to the underside of said lid; and ii) a plurality of spaced apart columns, each said column being of a width approximately of a width of each said compartment and having indicia thereon indicating the length and color of said respective set of rivets within said compartment, so that when said lid is opened the person can see all of said sets of rivets within all of said compartments and easily identify their lengths with the aid of said chart.

* * * * *